United States Patent [19]

Yara

[11] Patent Number: 4,474,109

[45] Date of Patent: Oct. 2, 1984

[54] T-SHIRT PRINTING APPARATUS WITH MULTIPLE DRYING BOOTHS

[75] Inventor: Chosuke Yara, Naha, Japan

[73] Assignee: Ryukyu Screen Printing Corp., Okinawa, Japan

[21] Appl. No.: 448,875

[22] Filed: Dec. 10, 1982

Related U.S. Application Data

[63] Continuation of Ser. No. 229,408, Jan. 29, 1981, abandoned.

[30] Foreign Application Priority Data

Feb. 6, 1980 [JP] Japan ..... 55-13682

[51] Int. Cl.³ ..... B41F 15/06

[52] U.S. Cl. ..... 101/115; 101/416 A

[58] Field of Search ..... 101/115, 123, 126, 416 A, 101/416 R

[56] References Cited

U.S. PATENT DOCUMENTS

| | | | |
|---|---|---|---|
| 2,690,118 | 9/1954 | Schwartz et al. | 101/115 |
| 3,854,398 | 12/1974 | Martin | 101/126 X |
| 4,084,504 | 4/1978 | Fuchs | 101/126 X |
| 4,273,042 | 6/1981 | Machida | 101/123 |

*Primary Examiner*—Edgar S. Burr
*Assistant Examiner*—David A. Wiecking
*Attorney, Agent, or Firm*—Jordan and Hamburg

[57] ABSTRACT

T-shirt printing apparatus of this invention for printing a desired pattern on a T-shirt comprises a support frame, upper and lower turntables rotatably mounted on the support frame, the upper and lower turntables being rotatable relative to each other on a horizontal plane coaxially, at least one print screen attached to the periphery of the upper turntable in a radial direction, a plurality of T-shirt mounting plates attached to the periphery of the lower turntable in a radial direction, the print screen and the T-shirt mounting plates being able to come in alignment with each other along with the relative rotation therebetween, wherein the improvement is characterized in that the printing apparatus further includes a drying device which is capable of drying and heat-treating T-shirts mounted on the T-shirt mounting plates during rotation of the T-shirt mounting plates along with the rotation of said lower turntable. Due to such construction, the operability of the entire printing operation is greatly enhanced.

1 Claim, 4 Drawing Figures

T-SHIRT PRINTING APPARATUS WITH MULTIPLE DRYING BOOTHS

This is a continuation of U.S. application Ser. No. 229,408 filed Jan. 29, 1981 now abandoned.

BACKGROUND OF INVENTION

This invention relates to a T-shirt printing apparatus, and more particularly, a manual or semi-automatic printing apparatus which is suitable for production of T-shirts with relatively small number (amount) but many or various kinds.

In general, T-shirt printing is conducted by two methods, one being the transfer printing method and the other is the direct printing method.

T-shirt printing apparatus of this invention is for the direct printing method. In direct printing method, three kinds of inks have been generally used, the emulsion, the plustisol and the expansion ink. Each ink requires the heat treatment or at least drying after the printing operation.

To be more specific, conventionally, T-shirt printing operation by direct printing method is conducted as follows. Primarily, a T-shirt is mounted on a T-shirt mounting plate. Subsequently print screens provided with desired patterns or illustrations thereon are superposed on the T-shirt mounting plate and are pressed to the T-shirt, thus effecting the original printing. Thereafter the T-shirt is removed from the T-shirt mounting plate and is subject to a drying operation by a suitable drying apparatus usually located remote from the printing apparatus, thereby completing the printing operation. However, in the above conventional printing operation, a considerable amount of time is spent before subjecting the T-shirt to drying or heat treatment after the original printing, thus making the entire printing operation including such drying inefficient.

Accordingly, it is an object of the present invention to provide a printing apparatus which can fully utilize the above waste time for a specific purpose, and more specifically, for drying and/or heat-treatment purpose, thus enabling the sufficient heat-treatment of T-shirts during the rotation thereof, resulting in the drastic shortening of the entire printing operation.

DETAILED DESCRIPTION OF THE DISCLOSURE

Figure 1:
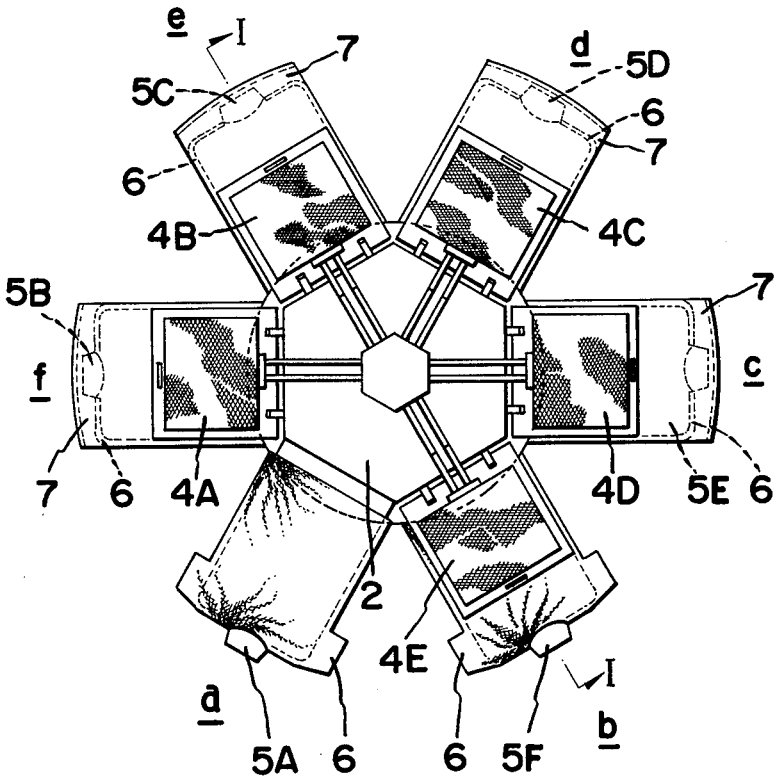
FIG. 1 is a plan view of the T-shirt printing apparatus of this invention.
Figure 2:
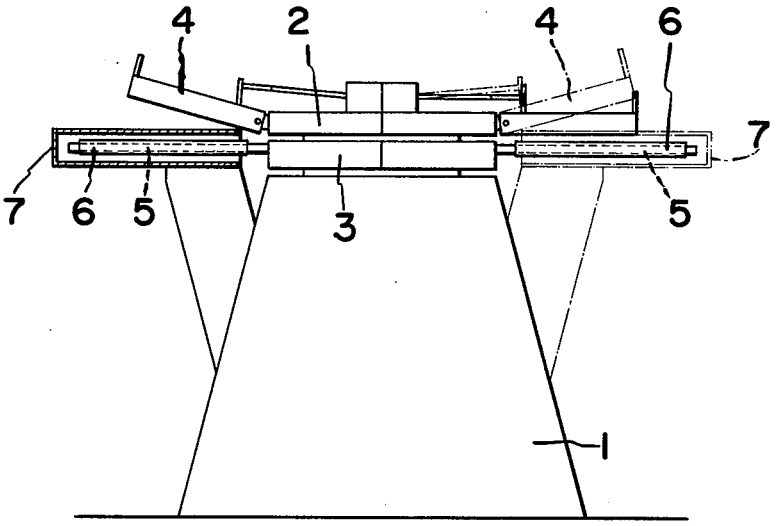
FIG. 2 is a cross sectional view of the above apparatus taken along the line I—I of FIG. 1.

One embodiment of the apparatus of this invention is disclosed in FIG. 1 and FIG. 2. As shown in the drawings, upper and lower turntables (2) (3) are rotatably mounted on the support frame (1) such that they are rotatably relative to each other on a horizontal plane coaxially. A plurality of print screens (4A) to (4E) are attached to the periphery of the upper turntable in a radial direction, while a plurality of T-shirt mounting plates (5A) to (5F) are attached to the periphery of the lower turntable (3) in a radial direction. The print screen (4) and the T-shirt mounting plates (5) can come in alignment with each other along with the above mentioned relative rotation therebetween. The printing apparatus of the above construction further includes a drying device which is capable of drying and heat-treating T-shirts (6) mounted on the T-shirts mounting plates (5) during rotation of the T-shirt mounting plate (5) along with the rotation of the lower turntable (3).

Although various constructions or modifications can be considered as to the T-shirt drying device (7), the device of the embodiment shown in FIG. 1 and FIG. 2 is constructed such that a plurality of hot air booths, through which the T-shirt mounting plates (5A to 5F) can rotate are attached radially to the side of the support frame (1).

Figure 3:
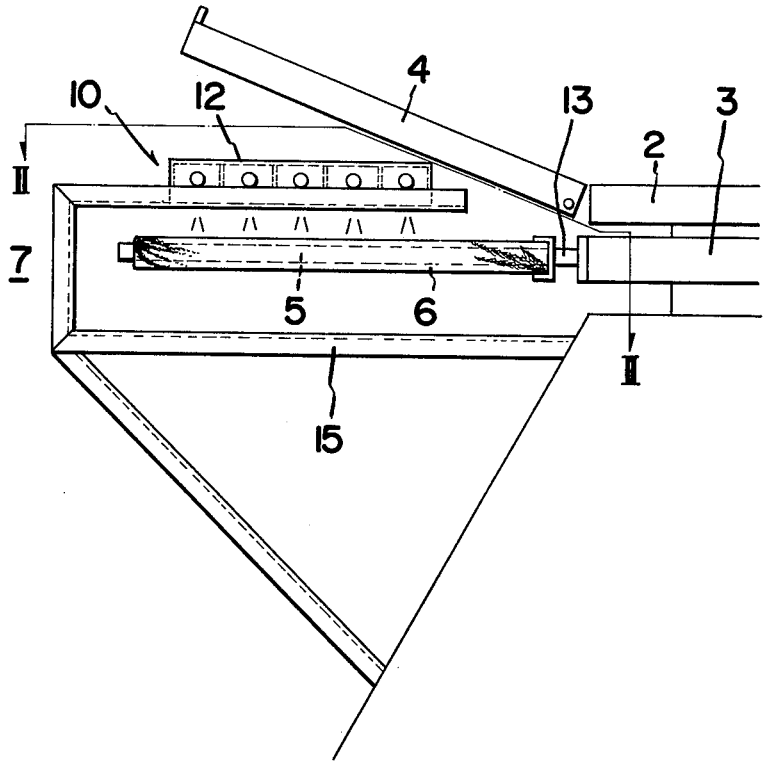
FIG. 3 is an enlarged partial front view of the apparatus showing another modification of the T-shirt drying device.
Figure 4:
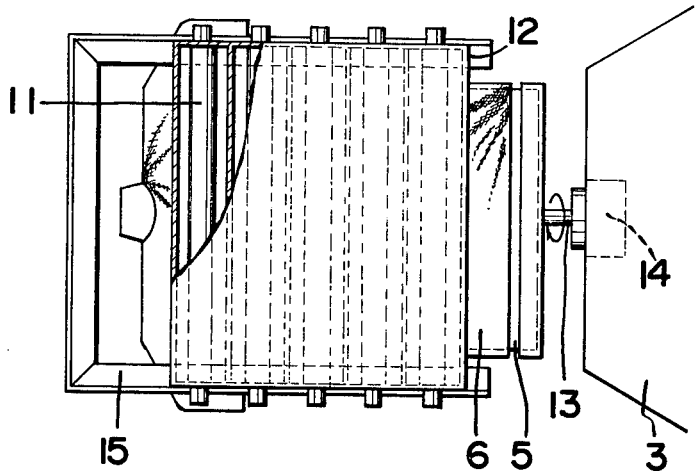
FIG. 4 is a plan view of the above apparatus taken along the line II—II of FIG. 3.

Another modification of the T-shirt drying device (7) is shown in FIG. 3 and FIG. 4, wherein the device (7) comprises a plurality of heating elements (10) which are disposed above T-shirt mounting plates (5). The heat element (10) is preferably made of a plurality of infrared heating tubes (11) encased in a casing (12). Such infrared tubes (11) can generate sufficient energy for drying T-shirt (6) and/or subjecting the T-shirt (6) to the heat treatment. Each heating element (10) is slidably mounted on a frame structure (15) in a radial direction. It is also possible to switch on and off the desired heat elements (10) so as to contribute for energy saving.

In FIG. 3 and FIG. 4, improvements are also made as to the T-shirt mounting plate (5). Namely, a connecting shaft (13) which connects the T-shirt mounting plate (5) to the lower turntable (3) can be rotated 180 degrees and can be fixed at the rotated position by a revolving device (14). Any known mechanism is applicable to such revolving device (14). Due to such construction, the T-shirt (6) which is provided with printed patterns on both sides of the T-shirt (6) can be also readily dried or subjected to heat treatment.

Still furthermore, although not shown in the drawings, the T-shirt mounting plate (5) may comprise a stationary plate fixed to the lower turntable (3) and a slidable plate which is slidably mounted on the stationary plate in a radial direction. Due to such construction, the T-shirt (6) mounted on the T-shirt mounting plate (5) can make the printing surface in a stretched condition prior to the printing operation.

The manner in which the T-shirt printing apparatus of this embodiment is operated is hereinafter disclosed in conjunction with FIG. 1 and FIG. 2.

A T-shirt (6) is mounted on the T-shirt mounting plate (5) at a position (a). The lower turntable (3) is rotated 60 degrees thus bringing the T-shirt mounting plate (3A) to a position (b). While holding the T-shirt mounting plate (5A) at the position (b), the print screens (4A), (4B), (4C), (4D), (4E) are rotated in sequence and superposed on the T-shirt mounting plate (5) one after another, thus printing a desired pattern on the surface of the T-shirt (6). After above printing operation, the lower turntable (3) is rotated another 60 degrees thus bringing the T-shirt mounting plate (5A) to a position (c). Simultaneously, a T-shirt mounting plate (5B) which is provided with a second T-shirt (6) at the position (a) is brought to the position (b). At the position (b), the print screens (4A), (4B), (4C), (4D), (4E) are superposed on the T-shirt mounting plate (5B) in sequence, thus printing a complex pattern on the surface of the T-shirt (b). In the above manner, T-shirt mounting plates (5A), (5B)—are rotated in sequence in a counter clockwise direction and when the T-shirt mounting plates (5A) (5B)—are returned to the position (a), the T-shirts (6) provided with a desired print pattern are removed from the T-shirt mounting plates (5A) (5B)—in sequence. In the above rotation of the T-shirt mounting plates (5A) (5B)—, these plates pass through the hot air booths which constitute the shirt drying device (7) so that the T-shirts (6) mounted on these plates (5A) (5B) —are dried and subjected to heat treatment. Accordingly, when the T-shirt (6) is removed from the mounting plate (5) at the position (a), such T-shirt (6) is completely dried or subjected to heat treatment, whereby the conventional drying process can be eliminated.

As has been described above, since the T-shirt printing apparatus of this invention can dry and heat-treat the T-shirts while they are being rotated, the conventional drying process can be eliminated or simplified, while since sufficient drying or heat treatment is effected, the adhering force of the print on the T-shirt is greatly improved.

What we claim is:

1. A printing apparatus for printing a desired pattern on an item of clothing comprising:

(a) a support frame, (b) upper and lower turntables mounted on said support frame, said upper and lower turntables being coaxially rotatable relative to each other along generally horizontal planes, said upper and lower turntables being rotatable about a common vertical axis, (c) a plurality of clothing mounting plates mounted on said lower turntable and adapted to receive items of clothing to be printed, (d) at least one print screen means mounted on said upper turntable and pivotal between a printing position and a non-printing position, said print screen means in said printing position contacting said clothing on said mounting plates to effect printing on said clothing, (e) rotational means for rotatably mounting said mounting plates on said lower turntable for rotation about a generally horizontal axis, said mounting plates thereby being rotatable 180 degrees to provide for printing on both sides of the clothing on said mounting plates, and (f) a plurality of hot air drying booths fixedly mounted on said support frame and disposed along the rotational path of said lower turntable to effect drying-by-heating of the clothing on said mounting plates, each of said hot air drying booths being disposed at spaced intervals along the rotational path of said lower turntable to thereby define a space between each successive hot air drying booths, said plurality of hot air drying booths each having an upper portion at least partially superimposed over said mounting plates, said support frame having a lower section disposed below said lower turntable, mounting bracket means extending from said lower section of said support frame, said plurality of hot air drying booths further comprising an outer section extending radially outwardly of said lower turntable and connecting said mounting bracket means to said upper portion superimposed over said mounting plates such that said hot air drying booths are fixedly supported from said lower section of said support frame outside the rotational path of said lower turntable to permit said lower turntable to be freely rotated to pass below said upper portion of said hot air drying booths, above said mounting bracket means, and radially inwardly of said outer section of said hot air drying booths, said upper portion of each of said hot air drying booths, said mounting bracket means and said outer section of each of said hot air drying booths thereby defining a generally U-shaped configuration through which said mounting plates with clothing thereon pass without contact such that the printing on both sides of said clothing is dried simultaneously, said print screen means in said non-printing position being disposed in a position above said upper portion of said hot air drying booths such that said print screen means passes over the top of said upper portion of said hot air drying booths as said upper turntable means is rotated, whereby said upper and lower turntables are freely rotatable relative to said fixedly mounted hot air drying booths, said lower turntable being rotatable through a plurality of successive station means, one of said station means being a receiving-removal station means where said items of clothing to be printed are received and removed from said clothing mounting plates, the next successive station means being printing station means to effect said printing on said clothing, the remaining station means being constituted by said plurality of hot air drying booths each spaced from one another to effect said drying-by-heating of said clothing on said mounting plates.

* * * * *